US005433914A

United States Patent [19]

Kida

[11] Patent Number: 5,433,914

[45] Date of Patent: Jul. 18, 1995

[54] METHOD FOR MAINTAINING PRESSURE IN CONTINUOUS HEAT TREATING MACHINE FOR SYNTHETIC FIBER TOW

[75] Inventor: Takahisa Kida, Okayama, Japan

[73] Assignee: Japan Exlan Company Limited, Osaka, Japan

[21] Appl. No.: 170,161

[22] PCT Filed: Jun. 22, 1993

[86] PCT No.: PCT/JP93/00834

§ 371 Date: Dec. 23, 1993

§ 102(e) Date: Dec. 23, 1993

[87] PCT Pub. No.: WO94/00628

PCT Pub. Date: Jan. 6, 1994

[30] Foreign Application Priority Data

Jun. 24, 1992 [JP] Japan ..... 4-191714

[51] Int. Cl.[6] ..... D01D 10/02

[52] U.S. Cl. ..... 264/345

[58] Field of Search ..... 264/345, 346

[56] References Cited

U.S. PATENT DOCUMENTS

| | | | |
|---|---|---|---|
| 3,098,260 | 7/1963 | Richeson | 264/346 X |
| 4,571,765 | 2/1986 | Okada et al. | 8/149.3 |
| 4,760,629 | 8/1988 | Paulini et al. | 28/256 |

FOREIGN PATENT DOCUMENTS

| | | |
|---|---|---|
| 0222214 | 12/1989 | European Pat. Off. . |
| 47-28247 | 10/1972 | Japan . |
| 53-103048 | 9/1978 | Japan . |
| 57-128252 | 8/1982 | Japan . |
| 60-7062 | 2/1985 | Japan . |
| 60-39470 | 3/1985 | Japan . |
| 62-110933 | 5/1987 | Japan . |
| 2-58386 | 12/1990 | Japan . |
| 2092191 | 8/1982 | United Kingdom . |

OTHER PUBLICATIONS

Translation of Japan 47-28,247 (Published Oct., 1972).
Translation of Japan 53-103,048 (Published Sep., 1978).

*Primary Examiner*—Leo B. Tentoni
*Attorney, Agent, or Firm*—Wenderoth, Lind & Ponack

[57] ABSTRACT

A continuous heat treating machine for synthetic fiber tow provides a method for maintaining pressure having excellent stability on maintaining the pressure inside of the pressure chamber while avoiding quality deterioration and while ensuring minimum leakage of steam for heating medium. The length and breadth dimensions of the exit pressure seal part are set to be narrower than those of the entrance pressure seal part. The method ensures minimum damage on heat treating fiber, gives minimum unit requirement of steam for heating medium, and offers a stable operation and uniform heat treatment.

4 Claims, 2 Drawing Sheets

METHOD FOR MAINTAINING PRESSURE IN CONTINUOUS HEAT TREATING MACHINE FOR SYNTHETIC FIBER TOW

TECHNICAL FIELD

This invention relates to a method for maintaining pressure in a continuous heat treating machine for synthetic fiber tow.

BACKGROUND ART

As a known important process of synthetic fiber production, a synthetic fiber tow which was imparted with false crimps by a crimping machine is subjected to heat treatment in a heat treating machine being provided with a pressure chamber filled with steam or other heating medium.

Several means were proposed to charge the synthetic fiber tow (referred also to as "crimped fiber lump" hereafter) into the pressure chamber in the as-crimped state or in an extended form and to draw out the crimped fiber lump from the pressure chamber while maintaining the pressure inside of the pressure chamber.

One of the means to maintain the pressure inside of the pressure chamber is to fill the pressure seal parts at the entrance and exit of the pressure chamber with the crimped fiber lump. Generally, this type of heat treating machine feeds the crimped fiber lump by sandwiching it between a pair of endless conveyor belts from upper and lower sides thereof (the conveyor is referred to simply as "sandwiching conveyor belts" hereafter). For this type of pressure seal method, the seal is obtained only by giving a higher friction resistance between the crimped fiber lump and the sandwiching endless conveyor belts at the pressure seal part to stop the leak of pressure in the pressure chamber.

To increase the friction resistance aforedescribed and to prevent the leak of steam or other heating medium from the pressure chamber, the apparent density of crimped fiber lump at the entrance of the pressure chamber is required to increase. However, the introduction of a crimped fiber lump having a high apparent density into the pressure chamber results in the increased fiber packing density on the sandwiching endless conveyor belts, which then requires a long period of heat treatment and results in an extended heat treating machine. In addition, within the pressure chamber, the crimped fiber lump develops thermal shrinkage along with the progress of heat treatment to decrease the cross sectional area thereof at the exit pressure seal part of the pressure chamber.

Consequently, the reduction of vertical resistance reduces the friction resistance between the crimped fiber lump and the sandwiching endless conveyor belts. Then, the pressure seal at the seal part is lost to blow out the crimped fiber lump to the outside of the exit pressure seal part of the pressure chamber. As a result, the pressure chamber becomes difficult to maintain its inside pressure.

To improve the disadvantage, a crimped fiber lump is extended before charging it into the pressure chamber. This method completes the heat treatment in a shorter time than the case of non-extended crimp fiber lump because it has less fiber packing density on the sandwiching endless conveyor belts than that of non-extended crimp fiber lump. Nevertheless, the method is unable to solve the problems that the crimped fiber lump is blown out from the exit pressure seal part and that the treating fiber suffers damage.

As a result, presently the method to fill both the entrance and exit pressure seal parts of the pressure chamber with the crimped fiber lump is not often adopted. Instead, a labyrinth seal is usually applied to the exit pressure seal parts. The labyrinth seal method has, however, disadvantages such that the method induces frequent fiber damages caused by the direct friction action of high temperature treating fiber on the labyrinth part, that the method accepts only the fiber which extended its crimps in advance, and that an increased pressure needs a deep labyrinth seal part. Thus, the labyrinth method is not a satisfactory one.

An alternative and improved method to maintain pressure inside of the pressure chamber is what is called "roller seal method". The method arranges a set of nip rollers at the entrance and/or exit pressure seal part to hold down the crimped fiber lump to give a sufficient pressure seal. In this method, however, in particular at the exit pressure seal part, the crimped fiber lump at an elevated temperature passes through a high hold down pressure zone, which induces fusing of filaments and damage on single filaments to result in a quality defect. A modified method to the roller seal method employs a cooling chamber at the inlet of the exit roller seal part to cool the crimped fiber lump before entering the seal part. This modification also has disadvantages such that the facilities become complex and need an elongated space and that the quality of treated fiber is not satisfactory.

As described above, there is no satisfactory method which prevents the extension of facilities, has an excellent pressure stability inside of the pressure chamber, and solves the quality problems such as damage of heat treated fiber.

The object of this invention is to provide a method for maintaining pressure inside of the pressure chamber while solving the problems described above relating to a continuous heat treating machine and maintaining a stable pressure inside of the pressure chamber without deteriorating the treated fiber, and responding to varied treatment conditions.

DISCLOSURE OF THE INVENTION

Figure 1:
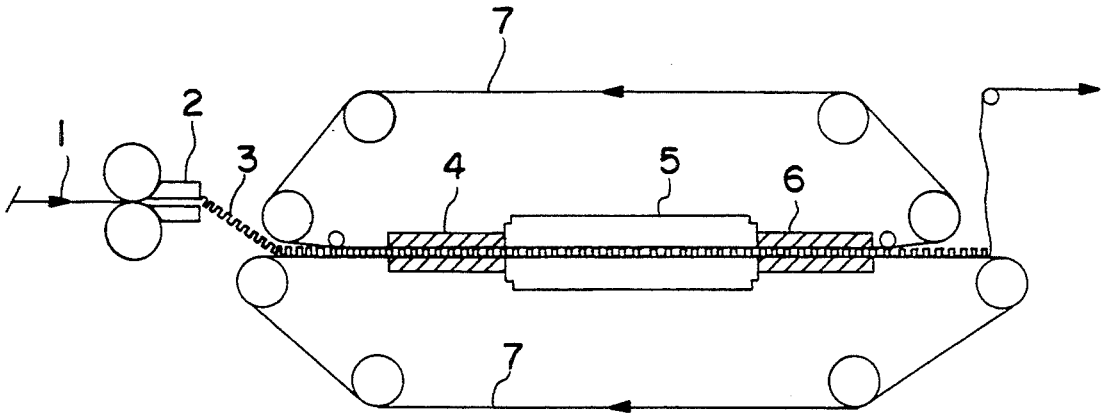
FIG. 1 shows a side sectional view of a continuous heat treating machine employed in a preferable embodiment of the method of the present invention.

The object of this invention is favorably achieved through a method for maintaining pressure in a continuous heat treating machine for synthetic fiber tow, which method comprises the continuous heat treatment of a crimped synthetic fiber tow by passing the tow through a pressure chamber being kept at or above atmospheric pressure and being filled with steam for heating medium while sandwiching the crimped synthetic fiber tow from upper and lower sides thereof by a pair of endless conveyor belts (sandwiching endless conveyor belts), wherein the length and breadth dimensions of opening of pressure seal part at the entrance and exit of the pressure chamber are selected to be narrower at the exit pressure seal part of the pressure chamber than those at the entrance pressure seal part thereof. According to the invention, the reduction of lengthwise dimension of the exit pressure seal of the pressure chamber is achieved by reducing the clearance between the sandwiching endless conveyor belts arranged at upper and lower sides of the treating crimped fiber lump, and the reduction of breadth dimension of the exit pressure seal part of the pressure chamber is achieved by installing a pair of endless belts travelling along both side edge surfaces of the crimped fiber lump at least at the exit pressure seal part of the pressure chamber and converging these belts toward the center axis of the passage of the crimped fiber lump. (The endless belts are referred to simply as "breadth-restricting endless belts" hereafter.)

The method of this invention reduces the length and breadth dimensions of the rectangular exit pressure seal part of the pressure chamber through which the crimped fiber lump travels after completing its heat treatment to become smaller than the dimensions of the entrance pressure seal part of the pressure chamber, and induces again the friction resistance between the treating crimped fiber lump and both the sandwiching endless conveyor belts and the breadth-restricting endless belts. As a result, the pressure inside of the pressure chamber is maintained satisfactorily without the trouble of blowing the treated crimped fiber lump outward while responding to varied treatment conditions in terms of size of the crimped fiber lump.

This invention will now be described in detail.

The continuous heat treating machine for synthetic fiber tow (referred to simply as "heat treating machine" hereafter, and the treatment with the heat treating machine is referred to simply as "heat treatment" hereafter) signified in this invention includes a vertical machine through which a tow travels vertically, a horizontal machine through which a tow travels horizontally, or an oblique machine. The following is the description of horizontal machine as a typical example. At the central area of the heat treating machine, a pressure chamber which is filled with steam for heating medium at atmospheric pressure or higher pressure is located. The pressure chamber is provided with entrance and exit openings which are packed with the treating crimped fiber lump to seal the pressure inside of the pressure chamber. The transport of the treating crimped fiber lump from the entrance pressure seal part through the pressure chamber to the exit pressure seal part is achieved by the movement of a pair of endless conveyor belts sandwiching the crimped fiber lump from upper and lower sides thereof sandwiching conveyor belts.

The charge of the synthetic fiber tow to the heat treating machine is carried out by a crimping machine located in front of the entrance pressure seal part.

According to the invention, a synthetic fiber tow which was imparted with false crimps by the crimping machine is charged into the entrance pressure seal part in a form of lump, or in a form of crimped fiber lump which was described before, by utilizing the discharge power of the crimping machine. The reason why the term "false" is applied to the crimped lump is that the crimped fiber lump may be subjected to extension again afterward.

The crimped synthetic fiber tow easily obtains high apparent density without damaging itself and increases the friction resistance at the pressure seal part to improve the sealability of pressure. A recommended crimp at this stage is in a range of from 8 pitch/inch to 12 pitch/inch. The range indicates that the travelling speed of tow at the inlet of crimping machine is approximately 10 times at the outlet thereof.

For a synthetic fiber tow having no false crimps, an additional device (multi-stage rollers, for example) is necessary to charge the tow into the pressure chamber. Furthermore, a tow having no false crimp is required to pass through a very narrow pressure seal part to maintain a sufficient pressure sealability, which unavoidably damages fiber. Consequently, the fiber tow having no false crimp looses the superiority of this invention to the roller seal method, and fails to achieve the invention.

The dimensions of the entrance pressure seal part of the pressure chamber should match the length and breadth dimensions of the crimped fiber lump formed by the crimping machine. This invention achieves the matching of the lengthwise dimension through the adjustment of clearance between a pair of sandwiching endless conveyor belts arranged at above and below the crimped fiber lump. Regarding the lengthwise dimension, if the sandwiching force to the crimped fiber lump is sufficient, the crimped fiber lump tends to widen its size to the lateral direction, so even a fixed width provides a sufficient friction resistance.

A pair of breadth-restricting endless belts travelling along the side edge surfaces of the crimped fiber lump may be located not only at the exit pressure seal part but also extending to the entrance pressure seal part and may be converged toward the center axis of the crimped fiber lump to control the width of the lump.

In this manner, the crimped fiber lump passed through the entrance pressure seal part proceeds into the pressure chamber while being nipped or covered with two pairs of endless conveyor belts, the sandwiching endless conveyor belts and the breadth-restricting endless belts.

At this stage, the discharge speed of the crimped fiber lump from the crimping machine (A m/min.) is not necessarily equal to the travelling speed of the conveyor belts described above (conveying speed: B m/min.) The only required condition is $B \geqq A$.

The condition of $B > A$ is the state with an extension of crimped fiber lump, and the value of B divided by A is defined as the extension rate. The extension rate is easily set and controlled by adjusting only the discharge speed from the crimping machine and/or the travelling speed of conveyor belts aforedescribed. In an actual operation, the extension rate is set considering the factors such that the heat treatment sets the crimps or not, that the necessary retention time of crimped fiber lump in the heat treating machine is secured or not, and that the full extension of crimps unavoidably causes the reduction of friction resistance at the exit pressure seal part. Common extension rate is in a range of from 1 to 4.

Accordingly, the crimped fiber lump passing through the pressure chamber while being nipped by the sandwiching endless conveyor belts or being covered further with the breadth-restricting endless belts described above is heated by steam for heating medium to raise its temperature. Most synthetic fibers shrink to the axial direction of the fibers and increase the apparent density of their crimped fiber lump to decrease its volume. In other words, the length and breadth dimensions of the crimped fiber lump at the exit of pressure chamber become smaller than those at the entrance of pressure chamber.

In a conventional heat treating machine which has the same length and breadth dimensions for both the entrance and exit pressure seal parts, the blowing out of steam for heating medium and of treating fiber lump occurs through the exit pressure seal part. The blowing-out disables the maintaining of the pressure inside of the pressure chamber and disables the heat treatment.

According to the invention, at the exit opening through which the crimped fiber lump having a reduced volume or reduced length and breadth dimensions passes, the length and breadth dimensions of the exit pressure seal part of the pressure chamber are smaller than those at the entrance pressure seal part thereof. This characteristic design induces the generation of friction resistance between the crimped fiber lump which was reduced in its volume and the pressure seal part on both top and bottom and sides thereof, and allows to perform the pressure seal at the exit pressure seal part.

The reduction of the length and breadth dimensions of exit pressure seal part is achieved either by fabricating an exit pressure seal part having smaller opening than that of entrance pressure seal part, or by, similar to the description of entrance pressure seal part given before, reducing the clearance between the sandwiching endless conveyor belts to reduce the lengthwise dimension and converging the breadth-restricting endless belts toward the center axis of crimped fiber lump to reduce the breadth dimension. As described above, when either lengthwise direction or breadth direction of crimped fiber lump is nipped, the dimension of other direction increases, so the reduction of dimension may be limited to either one of the length and breadth directions.

The sandwiching endless conveyor belts at top and bottom sides of the crimped fiber lump are fabricated with a material having a high heat resistance and abrasion resistance and having good permeability to steam for heating medium and are travelling through the heat treating machine from the inlet to outlet. The breadth-restricting endless belts at both side edges of the crimped fiber lump are requested to have the same material characteristics as the sandwiching endless conveyor belts. However, the breadth-restricting endless belts may have the travel range from the entrance pressure seal part to the exit pressure seal part, or only at the exit pressure seal part. For the travel of breadth-restricting endless belts, a driving system is not necessarily required. Instead, for example, the breadth-restricting endless belts may be nipped in between a pair of sandwiching endless conveyor belts at the edges of the latter, and the width at the exit pressure seal part or both at the entrance and exit pressure seal parts where the breadth-restricting endless belts pass through may be provided with a width control way.

The degree of the ratio of length and breadth dimensions of the exit pressure seal part to those of entrance pressure seal part depends on the type and total number of denier of treating crimped fiber lump, number of crimp pitches, designed extension rate, shrinkage of fiber, and pressure of steam for heating medium applied to the pressure chamber, so the value is not commonly specified. Regarding the most affecting factors relating to the pressure of steam for heating medium, the reduction rate of length and breadth dimensions (the reduction rate, %, of the exit dimension to the entrance dimension) is: 10–18% in length and 1–3% in breadth at around 1 kg/cm$^2$ G, 18–22% in length and 3–7% in breadth at 2 kg/cm$^2$ G, and 22–25% in length and 7–12% in breadth at 3 kg/cm$^2$ G.

According to the method described above in detail, even if the length and breadth dimensions of the heat treating crimped fiber lump vary by the heat treatment, the clearance between the crimped fiber lump and the exit pressure seal part, through which steam for heating medium leaks, becomes narrower because the length and breadth dimensions of the exit pressure seal part are set to narrower size than that at the entrance pressure seal part. In addition, since the crimped fiber lump is packed into the pressure seal part, even the compressing force applied to the fiber is significantly weak compared with the roller sealing method which presses the crimped fiber lump at a high pressure while leaving the space on both side edges of the fiber lump, the sufficient pressure seal effect is attained. With the same reason, a deep labyrinth seal is not required. Furthermore, particularly at the exit pressure seal part, a pair of breadth-restricting endless belts are placed on both side edges of the crimped fiber lump between the crimped fiber lump and the fixed centering members, which prevents the friction action at both side edges of the crimped fiber lump.

[Embodiment]

This invention is described in more detail in the following referring to the drawings.

FIG. 1 shows the side sectional view of a continuous heat treating machine employed in a preferable mode of the method of this invention. A synthetic fiber tow 1 is charged from the left side of the figure and is formed into the crimped fiber lump 3 through the crimping machine 2. The crimped fiber lump 3 is then sandwiched by a pair of endless conveyor belts 7 and is transported along with the endless conveyor belts 7 which travels through the entrance pressure seal part 4, the pressure chamber 5, and the exit pressure seal part 6, and the lump is discharged to the right end of the machine.

Figure 2:
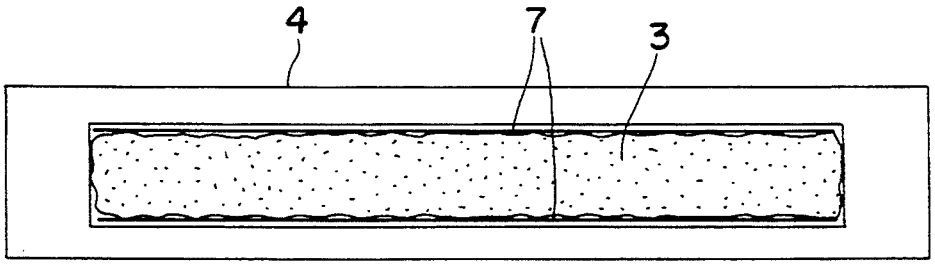
FIG. 2 shows a cross sectional view of the entrance pressure seal part 4 of FIG. 1, which is viewed in lateral direction to the travel of a crimped fiber lump.

FIG. 2 shows the cross sectional drawing of the entrance pressure seal part 4 of FIG. 1, which is viewed in lateral direction to the travel of the crimped fiber lump. The figure shows a pair of sandwiching endless conveyor belts 7 located above and below the crimped fiber lump 3.

Figure 3:
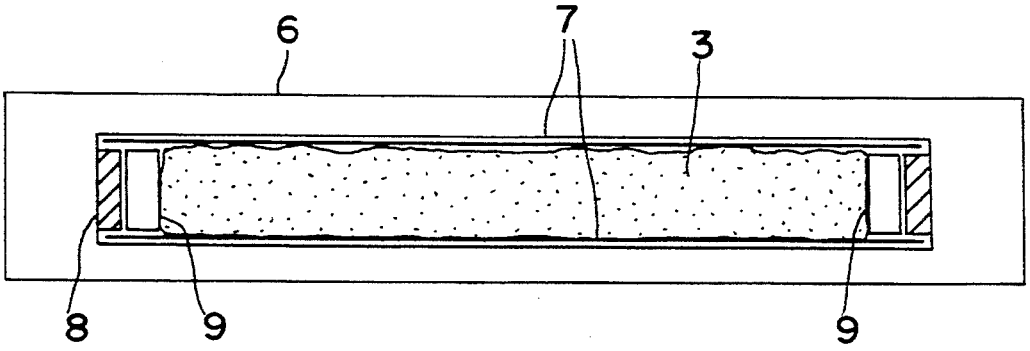
FIG. 3 shows a cross sectional view of the exit pressure seal part 6 of FIG. 1, which is viewed in lateral direction to the travel of a crimped fiber lump.

FIG. 3 shows the cross sectional drawing of the exit pressure seal part 6 of FIG. 1, which is viewed in lateral direction to the travel of the crimped fiber lump. The figure shows a pair of sandwiching endless conveyor belts 7 at above and below the crimped fiber lump 3 and a pair of breadth-restricting endless belts 9 at both side edge surfaces of the crimped fiber lump and a pair of fixed centering members 8 at the outside of the breadth-restricting endless belts within the exit pressure seal part.

Figure 4:
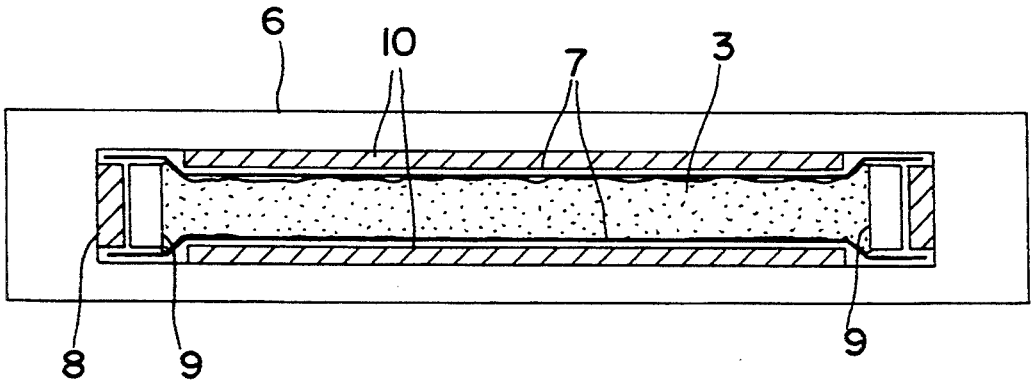
FIG. 4 shows a cross sectional view of the exit pressure seal part 6 of another embodiment of this invention.

FIG. 4 shows the cross sectional drawing of exit pressure seal part 6 of another embodiment of this invention. The figure shows a pair of adjusting members 10 and a pair of sandwiching endless conveyor belts 7 at above and below the crimped fiber lump 3 and a pair of breadth-restricting endless belts 9 at both side edge surfaces of the crimped fiber lump and a pair of fixed centering members 8 at the outside of the breadth-restricting endless belts within the exit pressure seal part.

EXAMPLE 1

Referring to the drawings, FIG. 1 is the cross sectional drawing of a continuous heat treating machine of the method of this invention. The synthetic fiber tow to be treated (example 1 employed the acrylic fiber tow having 880 thousands of total denier) was charged from the left side of the drawing and was formed into the crimped fiber lump 3 through the crimping machine 2 at a travel speed of 12 m/min. The crimped fiber lump 3 was then sandwiched in between a pair of sandwiching endless conveyor belts 7 which were travelling toward the right side of the drawing at a travelling speed of 18 m/min. The sandwiching endless conveyor 7 with the crimped fiber lump 3 entered the rectangular opening of the entrance pressure seal part 4 having the size of 18 mm in length and 200 mm in breadth and travelled through the pressure chamber 5. The extension rate of the crimped fiber lump 3 was 1.5.

FIG. 2 is the cross sectional drawing of the entrance pressure seal part 4 of FIG. 1, which is viewed in lateral direction to the travel of the crimped fiber lump 3. As seen in the figure, no breadth-restricting endless belts which should nip the side edges of the crimped fiber lump 3 was installed at the part. Nevertheless, no clearance was observed between the crimped fiber lump 3 and the surrounding surface of the rectangular entrance pressure seal part 4.

The exit pressure seal part 6 was a rectangular passage having the same length and breadth dimensions with the entrance pressure seal part 4 and it had a pair of fixed centering members 8 to reduce the breadth. The exit pressure seal part 6 was further provided with a pair of breadth-restricting endless (rubber) belts 9 travelling at both side edges of the crimped fiber lump 3. As a result, the actual breadth dimension became to 190 mm (refer to FIG. 3).

The pressure chamber 5 introduced steam for heating medium from both top and bottom thereof and drained the condensate from bottom thereof. (Both introducing openings and drain openings were not shown in FIG. 1.)

In this example, the steam of 2.0 kg/cm$^2$ G was introduced to the pressure chamber, and the fluctuation of pressure within the pressure chamber during the heat treatment was only within a range of $\pm$0.06 kg/cm$^2$, and very little leak of steam was observed through the entrance pressure seal part and even through the exit pressure seal part.

The ratio of the steam charge rate, which was determined by a steam flow rate accumulator located on the steam charge piping, to the condensate draining rate, which was determined by a drain flow rate accumulator, was 96.4 wt. %. The value is affected by the water content of treating crimped fiber lump itself so that the value does not give a definite ratio. Nevertheless, the value is a useful index to know the magnitude of steam leak from the pressure seal parts, and the measured result suggests that the pressure seal part has a high grade of sealability.

Similar with FIG. 2, the exit pressure seal part 6 is illustrated in FIG. 3 as the cross sectional drawing viewed in lateral direction to the travel of crimped fiber lump. FIG. 3 shows that the treating crimped fiber lump 3 is sandwiched in between a pair of sandwiching endless conveyor belts 7 and is nipped by a pair of breadth-restricting endless belts 9 at both side edge surfaces thereof. After completing the procedure of Example 1, all driving components were stopped and the exit pressure seal part was disassembled to inspect. Visual observation gave no gap between the crimped fiber lump 3 and the surrounding exit pressure seal part 6.

The heat treated crimped fiber lump of this example was subjected to adequate post-treatment and was evaluated for the fiber physical properties. The evaluated physical properties were: range of dyeability (difference between the maximum and the minimum dyeability) which indicates the nonuniformity of dyeability in the direction of length and breadth of tow; degree of damage which is expressed by the rate (%) of cracked single filament having the crack length at or longer than the fiber diameter, which degree of damage is determined by microscopic observation of heat-treated 200 filaments; and friction rate which is expressed by the rate (%) of single filaments damaged or broken by friction, which friction rate is determined by microscopic observation of heat treated 200 filaments collected only from both side edges of the crimped fiber lump.

When the exit pressure seal part works well, the values of first and the second evaluation items become small. The reasons are that a poor pressure sealability exposes the treating fiber lump to a wide fluctuation of pressure and allows blow out of steam from the pressure seal part, which causes a nonuniform heat treatment and a uneven dyeing, and that when hot fibers impinge against the surrounding solid wall, they separate into single filaments and suffer fracture and crack damages. The last evaluation item, friction rate, indicates the degree of friction of fiber at both side edge walls of the exit pressure seal part. Smaller value of friction rate is favorable.

The evaluation result was 0.58% of range of dyeability, 2.0% of degree of damage, and 1.1% of friction rate. These values showed that the method of this example is an excellent one to maintain pressure inside of the pressure chamber. Also the result shows that the method provides a high quality heat treated fiber tow including both side edge surfaces of the crimped fiber lump.

Comparative Example 1

A heat treating machine having the configuration used in Example 1 was modified to a roller seal type where the lower side of the sandwiching endless conveyor belts was left for the transport of crimped fiber lump while upper side thereof was removed and where both the entrance pressure seal part and the exit pressure seal part were replaced with nip-roll seal units. The heat treatment was performed under the same condition with that in Example 1. The required surface pressure of nip-rolls to prevent possible steam leak from the entrance and exit nip-roll seal units was 3 kg/cm$^2$ G at the entrance pressure seal part and was 5 kg/cm$^2$ G at the exit pressure seal part.

The variation of pressure inside of the pressure chamber was within a range of $\pm$0.04 kg/cm$^2$, and the condensate drain flow ratio was 97.0 wt. %, and there occurred no problem on maintaining pressure and on steam leak.

The range of dyeability was good at 0.50%. The degree of damage was, however, as high as 30%, which suggested the occurrence of severe damage at the exit nip-roll seal part. The friction rate was not able to evaluate because no side edge face of crimped fiber lump was formed to evaluate the characteristic.

Comparative Example 2

A heat treating machine having the configuration used in Example 1 was modified to remove the fixed centering members 8 at the exit pressure seal part 6 and to remove the breadth-restricting endless belts 9. The heat treatment was performed under the same condition with that in Example 1. Intermittent blow out of crimped fiber lump accompanied with steam blow out was observed at the exit pressure seal part. No smooth operation of the machine was achieved, but small amount of samples for evaluation were collected.

The evaluation result was $\pm 0.50$ kg/cm$^2$ of pressure variation, 63.4 wt. % of condensate drain ratio, 2.58% of range of dyeability, 25% of degree of damage, and 8.0% of friction rate. With the visual observation, non-uniform heat treatment, severe steam leak, and severe damage on fibers were identified. The collected samples showed a severe friction damage, which validated the superiority of the breadth-restricting endless belts employed in Example 1 to prevent the friction damage.

EXAMPLE 2

A heat treating machine having the configuration used in Example 1 was modified to install a pair of fixed centering members 8 in the exit pressure seal part while maintaining the same shape of the exit pressure seal part with Example 1 having the size of 14 mm in length and 200 mm in breadth, and was modified to remove a pair of breadth-restricting endless belts travelling through the exit pressure seal part. The heat treatment was performed under the same condition with that in Example 1. The operation of the machine was smooth and provided sufficient volume of samples for evaluation. Steam leak was not observed at the entrance pressure seal part, and slight leak of steam occurred at the exit pressure seal part.

The evaluation result was $\pm 0.08$ kg/cm$^2$ of pressure variation, 93.7 wt. % of condensate drain ratio, 0.66% of range of dyeability, 4.0% of degree of damage, and 4.3% of friction rate. These values suggested that the pressure within the pressure chamber was stably maintained with minimum steam leak and that the heat treatment with uniform and least damage was performed. Nevertheless, absence of breadth-restricting endless belts induced the friction damage to some degree compared with Example 1.

EXAMPLE 3

A heat treating machine having the configuration used in Example 1 was modified to add a pair of adjusting members 10 at above and below the crimped fiber lump 3 to reduce the clearance between the sandwiching endless conveyor belts, (refer to FIG. 4, the cross sectional drawing viewing in lateral direction to the travel of crimped fiber lump at the exit pressure seal part). The heat treatment was performed under the same condition with that in Example 1. The operation was quite stable, and no steam leak was observed both at the entrance and exit pressure seal parts.

The evaluation result was $\pm 0.03$ kg/cm$^2$ of pressure variation, 97.7 wt. % of condensate drain ratio, 0.43% of range of dyeability, 0.5% of degree of damage, and 0.6% of friction rate. These values show the excellent performance on maintaining pressure inside of the pressure chamber and on quality of heat treated fiber.

As described above in detail, the method of this invention stably maintains the pressure of steam for heating medium for heat treatment without damaging the heat treating fiber with cracks, flaw, or breaking. Additionally, the method of this invention is the one giving a minimum nonuniformity such as uneven dyeing and allowing a highly stable operation, and the one dealing with varied treatment conditions with various sizes of heat treated crimped fiber lumps. Regarding the industrial superiority, the method of this invention is the one offering energy saving with the least steam leakage giving the minimum unit requirement of steam for heating medium, and the one offering a hygiene work environment with no discharge of steam for heating medium to the work place, which effects give a major significance of industrial applications.

I claim:

1. A method for maintaining pressure in a continuous heat treating machine for synthetic fiber tow comprising continuously heat treating a crimped synthetic fiber tow by passing the tow through a pressure chamber having an entrance pressure seal part and an exit pressure seal part and being kept at or above atmospheric pressure and being filled with steam for heating medium while sandwiching the crimped synthetic fiber tow from upper and lower sides thereof by a pair of endless conveyor belts, wherein the length and breadth dimensions of the exit pressure seal part are narrower than those at the entrance pressure seal part.

2. A method for maintaining pressure in a continuous heat treating machine for synthetic fiber tow of claim 1 wherein a pair of endless belts are located to travel along both side edge surfaces of the synthetic fiber tow at least at the exit pressure seal part of the pressure chamber, and wherein the endless belts are converging toward the center axis of the passage of the synthetic fiber tow.

3. A method for maintaining pressure in a continuous heat treating machine for synthetic fiber tow of claim 1, wherein the clearance between the endless conveyor belts arranged at the upper and lower sides of the synthetic fiber tow is reduced at the exit pressure seal part of the pressure chamber.

4. A method for maintaining pressure in a continuous heat treating machine for synthetic fiber tow of claim 2, wherein the clearance between the endless conveyor belts arranged at the upper and lower sides of the synthetic fiber tow is reduced at the exit pressure seal part of the pressure chamber.

* * * * *